United States Patent [19]

Binder et al.

[11] Patent Number: 4,568,797

[45] Date of Patent: Feb. 4, 1986

[54] READILY CONNECTABLE AND DIRECTLY SOLDERED MULTIWIRE ELECTRIC CONDUCTOR

[75] Inventors: Germaine Binder; Albert Joye, both of Chauny, France

[73] Assignee: Thomson-Cuivre, Courbevoie, France

[21] Appl. No.: 589,327

[22] Filed: Mar. 14, 1984

[30] Foreign Application Priority Data

Mar. 18, 1983 [FR] France ..... 83 04487

[51] Int. Cl.[4] ..... H01B 5/08

[52] U.S. Cl. ..... 174/128 R; 57/223; 174/119 R

[58] Field of Search ..... 174/119 R, 119 C, 126 CP, 174/128 R, 130; 428/373; 57/218, 221, 232, 223

[56] References Cited

U.S. PATENT DOCUMENTS

| | | | |
|---|---|---|---|
| 2,132,235 | 10/1938 | Green | 174/128 R |
| 2,196,855 | 4/1940 | Dietloff | 174/119 C |
| 2,336,219 | 12/1943 | Brown | 174/119 R |
| 3,683,103 | 5/1972 | Mancino | 174/119 C |
| 4,039,743 | 8/1977 | Gommans | 174/128 R X |

FOREIGN PATENT DOCUMENTS

| | | |
|---|---|---|
| 2528726 | 12/1976 | Fed. Rep. of Germany . |
| 2276668 | 1/1976 | France . |
| 2085644 | 4/1982 | United Kingdom . |

OTHER PUBLICATIONS

Hawley, G. G.; Condensed Chemical Dictionary; Eighth Edition; Van Nostrand Reinhold Co.; 1950.

*Primary Examiner*—A. T. Grimley
*Assistant Examiner*—Morris H. Nimmo

[57] ABSTRACT

A readily connectable and directly soldered multiwire electric conductor comprises a conducting core of assembled elementary wires each provided with a coating of metal or fusible alloy which can be employed as a solder. The conductor further comprises a binder which performs two functions, namely the function of retaining the elementary wires in their assembled state in order to facilitate the connection of the conductor and the function of soldering flux.

3 Claims, 6 Drawing Figures

READILY CONNECTABLE AND DIRECTLY SOLDERED MULTIWIRE ELECTRIC CONDUCTOR

BACKGROUND OF THE INVENTION

1. Field of the Invention

The present invention relates to a readily connectable and directly soldered multiwire electric conductor.

2. Description of the Prior Art

In the majority of applications, electric conductors are connected to appliances, electric components or to other electric conductors. In connecting operations, an electric conductor is often cut to the required length and its ends are bared and inserted in connectors or connecting lugs, or alternatively soldered to their connecting points.

In the case of a single-wire conductor, these operations are usually performed without difficulty since its conducting core is relatively rigid.

When a multiwire conductor is used, its conducting core formed of elementary wires assembled together in one or a plurality of strands is relatively flexible. Moreover, in the cut and bared ends of said conductor, the elementary wires of the strands become loose and spread out or are ready to spread out under the slightest mechanical impact.

The operation which involves insertion of these ends in connectors or connecting lugs or the operation which consists in soldering or brazing these ends to the connecting points becomes a difficult procedure.

This difficulty proves to be even more serious when it is necessary to perform operations in which the conductor is connected by means of automatic machines.

Multiwire electric conductors which are readily connectable and can be directly soldered or brazed have not been available up to the present time.

In the case of certain known types of multiwire conductors, the bared or tinned elementary wires are maintained in the assembled state by means of tin or a fusible metal alloy or a plastic material. If the ends of the conductors are bared, their elementary wires do not spread or open-out. Multiwire conductors of this type are in fact readily connectable. However, at the time of soldering or brazing to their connecting points, these known multiwire conductors require an addition of soldering flux and in most instances an addition of solder. In consequence, these known types of multiwire conductors cannot be directly soldered or brazed.

SUMMARY OF THE INVENTION

The aim of the present invention is to circumvent these disadvantages and to provide a multiwire electric conductor in which, on the one hand, the wires or strands at the cut and/or bared ends are not opened-out or liable to open-out readily and thus to hinder the introduction of said ends in connectors and connecting lugs as well as soldering of said ends to the connection points. On the other hand, the ends of said wires or strands can be directly soldered or brazed without requiring any addition of solder or fusible metal alloy, or soldering flux.

In accordance with the invention, a readily connectable and directly soldered multiwire electric conductor having a conducting core formed of one or a plurality of strands of elementary wires essentially comprises a conducting core of assembled elementary wires provided with an individual coating of metal or fusible alloy which can be employed as a solder. Said conductor further comprises a binder which performs at least two functions, namely the function of retaining said elementary wires in their assembled state in order to facilitate the connection of the conductor and the function of soldering flux so as to permit direct soldering of the conductor to its connection point.

Automatic connection of a conductor of this type to a connector is thus facilitated. In fact, in order to form a brazed connection, it is only necessary to heat the assembly to be connected without any addition either of material or of soldering flux.

BRIEF DESCRIPTION OF THE DRAWINGS

Other features of the invention will be more apparent to those skilled in the art upon consideration of the following description and accompanying drawings, wherein.

DESCRIPTION OF THE PREFERRED EMBODIMENTS

Figure 1:
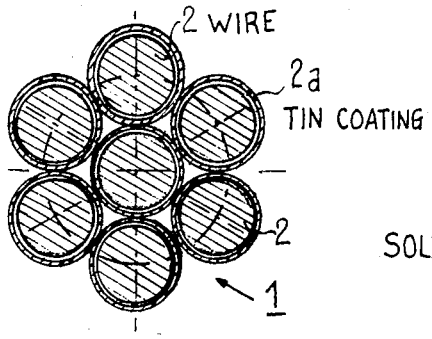
FIG. 1 is a schematic cross-sectional view of a conducting core of a multiwire conductor of known type formed of a strand of elementary wires.

A multiwire electric conductor 1 usually comprises a conducting core formed of one or a plurality of strands of elementary wires 2 as illustrated schematically in FIG. 1. This electric conductor 1 is often protected by an outer sheath (not shown) formed of one or a number of layers of electrically insulating material.

The elementary wires 2 are often provided with an individual tin coating 2*a*. When the conductor 1 is cut transversely and stripped of its outer sheath at the ends of the conductor, the elementary wires 2 of its conducting core become loose and open-out freely or tend to open-out under the slightest mechanical impact.

Opening-out of the elementary wires 2 of the bared ends of the conductor 1 makes it difficult to solder said ends or to introduce them into connectors or connecting lugs of conventional types (not shown).

In known conductors, the usual operation which consists in tinning the metal core of the elementary wires 2 is intended to protect these wires against corrosion or oxidation and to permit brazing. When a conducting core of a conductor of this type is heated to a temperature above 232° C. which is the melting point of tin, the elementary wires 2 fail to adhere to each other so as to form a rigid assembly after cooling and cannot be soldered to their connection points.

In the case of known conductors in which tinned or non-tinned elementary wires are held together by means of tin or in which tinned wires are assembled by means of a fusible metal alloy or a plastic material, a similar problem arises. When these wires are heated to a temperature above the melting point of the tin or of the alloy or plastic material, the wires no longer adhere to each other and cannot be soldered or bonded to their connection points.

This difficulty in regard to self-soldering and soldering of these elementary wires 2 is caused by contamination of the tin coating on these wires by oxides formed by residues of wire-drawing lubricant, by plastic coatings or by the anticorrosion agent employed. For the purpose of agglomeration or bonding to a connection point, these tinned elementary wires 2 usually entail the need for an addition of fusible metal or alloy and of soldering flux.

Figure 2:
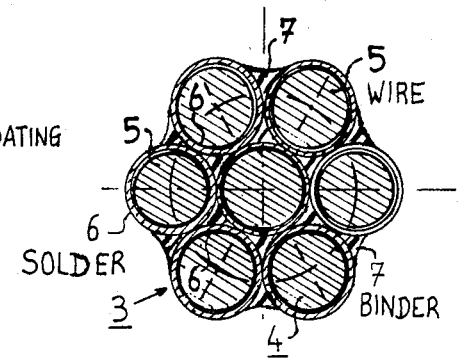
PRIOR ART FIG 2
FIG. 2 is a partial schematic cross-sectional view showing a conducting core of a multiwire electric conductor constructed in accordance with the invention and formed of a strand of elementary wires maintained in the assembled state by means of a bonding product.

In accordance with the invention, in order to overcome these disadvantages, a multiwire electric conductor 3 as illustrated in FIG. 2 comprises a conducting core formed of one or a plurality of strands 4 of elementary wires 5 provided with an individual coating of fusible metal or alloy which is suitable for use as a solder 6 such as tin and with a binder or retaining product 7 consisting of a substance or a mixture of substances. This binder 7 is a film-forming material or in other words is capable of forming an adherent, non-corrosive pellicle which is preferably fusible and performs at least two functions, namely a function of retaining the elementary wires 5 in their assembled state and a function of soldering flux. There can be deposited on this conducting core with its coating of binder 7 one or a number of layers of electrically insulating material (not shown) in order to form a protective sheath on the conductor 3.

The fusible metal or alloy 6 which covers the elementary wires 5 consists of a metal or alloy which is usually employed as a solder such as tin or a tin-lead alloy.

When the multiwire conductor 3 is cut and bared at its ends, the elementary wires 5 retained by the binder 7 remain in their assembled state.

The ends of conductors prepared in this manner can readily be introduced into connectors or connecting lugs. This operation can be carried out without any difficulty by an automatic machine. Furthermore, the bared ends of the conductor 3 which are coated with fusible metal or alloy 6 can be directly soldered or brazed without requiring any external addition of soldering flux in view of the fact that the layer of binder 7 already performs the function of a flux of this type.

In accordance with the invention, the multiwire conductor 3 can also be made rigid either over its entire length or locally, that is to say at any point of its length or at its ends by soldering of the elementary wires 5 to each other. To this end, those points of the conductor in which rigidity must be obtained are heated to a temperature above the melting point of the layer of fusible metal or alloy to be employed as solder 6 for the elementary wires 5.

The layer of binder 7 which performs the function of soldering flux facilitates the formation of a compact bundle by soldering. Heating of the conductor 3 can be carried out in accordance with a known technique, namely by hot air, by induction, by Joule effect or by high frequency.

In accordance with the invention, the binder 7 consists of rosin or an activated rosin or else a rosin which may or may not be activated and is plasticized.

In one exemplified embodiment, an activated and plasticized rosin consists of a 20 wt % solution in isopropyl alcohol of a rosin modified by 0.2 wt % with respect to dry substance of an organic chloride such as mono or diethylamine hydrochlorate and by 10 wt % with respect to dry substance of a plasticizing resin such as a polyvinyl alcohol.

The binder 7 is applied as a coating on the multiwire electric conductor 3 by dipping, spraying or any other known technique at the time of manufacture of the strand or prior to fitting of the protective sheath on the conductor 3.

Figure 3:
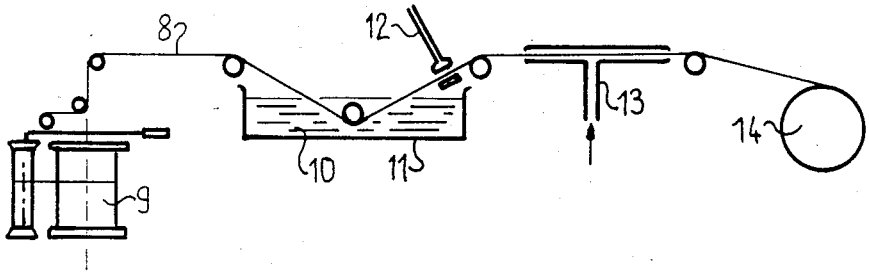
FIG. 3 is a schematic view of part of a production line for processing the conductor of FIG. 2 in accordance with one exemplified embodiment.

In one example which is illustrated schematically in FIG. 3, application of the binder 7 is performed by dipping. The strand 8 is composed of nineteen elementary wires of copper having a diameter of 0.20 mm and coated individually with a film-layer of tin three microns in thickness. The strand is unwound from a storage reel 9, then passed into a solution 10 of binder 7 contained in a tank 11.

The strand 8 coated with binder 7 is delivered from the tank 11, freed from excess product by a compressed-air drying unit 12, introduced into a hot-air drying device 13, then wound onto a storage reel 14.

This dipping process can be employed for applying the binder 7 to a five-wire strand during manufacture.

Figure 4:
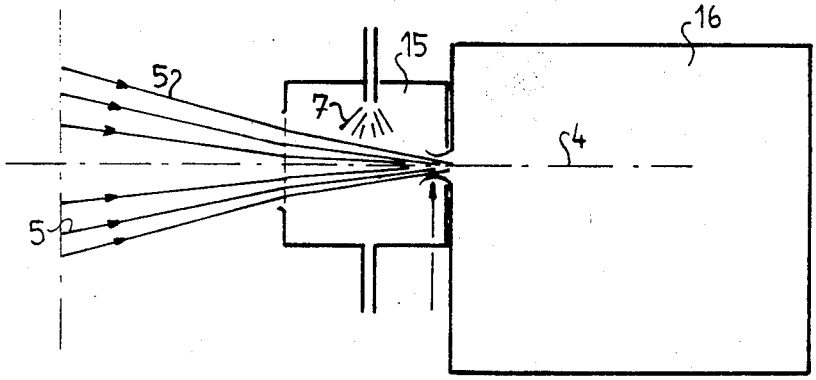
FIG. 4 is a schematic view of part of a production line for processing the conductor of FIG. 2 in accordance with another exemplified embodiment.

In another exemplified embodiment which is illustrated partially and schematically in FIG. 4, the binder 7 is applied by spray-coating during an operation which consists in twisting elementary wires 5. A binder solution 7 is sprayed by means of a device 15 onto elementary wires 5 constituting a strand 4 prior to introduction of said wires into a stranding unit 16.

In a quality test performed on a multiwire conductor 3 having a conducting core formed of a strand of tinned elementary wires 5 coated with a binder 7 consisting of activated and plasticized rosin such as the rosin solution of the example described in an earlier paragraph, a sample of this conductor is cut transversely. In the cut end of this conductor 3, it is observed that the elementary wires 5 remain closely grouped together. A section of this sample is heated to a temperature of 250° C. which is higher than the melting point of tin. After cooling, it is found that, in this section of conductor, all the elementary wires 5 which constitute the conducting core are welded together.

Figure 5:
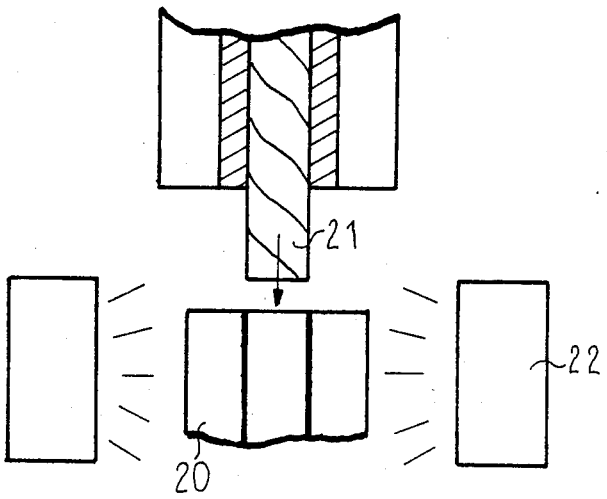
FIGS. 5 and 6 illustrate a method of formation of a connection.
Figure 6:
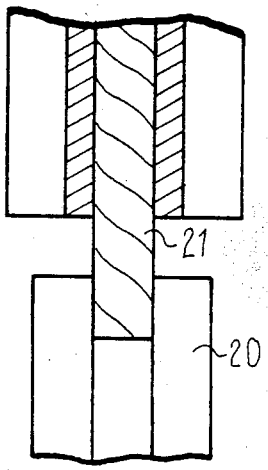

A multiwire electric conductor 3 produced in accordance with the invention thus comprises a multiwire conducting core formed of one or a plurality of strands. The core can be cut and bared without any attendant danger of coming apart and opening-out at the level of a transverse cut. Operations involved in connection of a conductor of this type are consequently facilitated. Such operations can also be made fully automatic as shown in FIGS. 5 and 6. These figures show the connection of a socket connector 20 to a strand 21. By way of example, the socket connector has previously been provided with an internal coating of tin.

To this end, the strand 21, the external diameter of which is very slightly smaller than the internal diameter of the socket, is inserted in this latter (as shown in FIG. 5). Heating means 22 which surround the connector socket have the effect of melting the coating 6 of fusible metal or alloy which has the intended function of a solder and surrounds the strand 21 while also having the effect of melting the tin lining of the socket, thus providing a brazed joint without any addition of material and soldering flux.

What is claimed is:

1. An electrical conductor comprising: a conducting core of a plurality of assembled individual electric wires, each wire being provided thereon with an individual heat solderable coating, and a binder soldering flux material between said coatings on adjacent wires and selected from the group consisting of rosin, activated rosin, and activated and plasticized rosin.

2. An electrical conductor comprising: a conducting core of a plurality of assembled individual electric wires, each wire being provided thereon with an individual heat solderable coating, and a binder soldering flux material between said coatings on adjacent wires and selected from the group consisting of rosin, activated rosin, and activated and plasticized rosin, about 0.2% by weight on a dry basis of an organic chloride, and about 10% by weight on a dry basis of a plasticizing resin.

3. A conductor according to claim 1, wherein said organic chloride is selected from the group consisting of monoethylamine and diethylamine, and said plasticizing resin is polyvinyl alcohol.

* * * * *